US005239518A

United States Patent [19]

Kazmar

[11] Patent Number: 5,239,518

[45] Date of Patent: Aug. 24, 1993

[54] LOW FREQUENCY SONAR PROJECTOR AND METHOD

[75] Inventor: Theodore R. Kazmar, Saugus, Calif.

[73] Assignee: Allied-Signal Inc., Morris Township, N.J.

[21] Appl. No.: 883,846

[22] Filed: May 15, 1992

[51] Int. Cl.[5] ..... H04R 17/00

[52] U.S. Cl. ..... 367/157; 367/163; 310/315; 310/337; 310/343; 29/25.35

[58] Field of Search ..... 310/315, 337, 343, 346; 367/163, 167, 155, 157; 29/25.35

[56] References Cited

U.S. PATENT DOCUMENTS

| | | | |
|---|---|---|---|
| 4,593,258 | 6/1986 | Block | 331/176 |
| 5,016,228 | 5/1991 | Arnold et al. | 367/163 |
| 5,041,800 | 8/1991 | Long et al. | 310/315 |
| 5,060,651 | 10/1991 | Kondo et al. | 128/660.07 |
| 5,065,068 | 11/1991 | Oakley | 310/357 |

FOREIGN PATENT DOCUMENTS 8705772 9/1987 United Kingdom .

*Primary Examiner*—J. Woodrow Eldred
*Attorney, Agent, or Firm*—Robert A. Walsh

[57] ABSTRACT

A low frequency sonar projector for use with a projector array having at least one ceramic stack comprised of lead magnesium niobate-lead titanate (PMN-PT) having a Curie temperature Tm approximately equal to the operating temperature of the projector. A mechanism is provided for applying heat to and for controlling the temperature of the ceramic stack to within a fixed operating range. A biasing circuit is included for providing a first electrical signal to polarize the ceramic stack. A driving circuit is also included for providing a second electrical signal to generate an output signal from the ceramic stack. Finally, a mechanism is included for transmitting the output signal from the ceramic stack to a fluid medium. In a preferred embodiment, a PMN-PT ceramic stack is in intimate enclosed contact with an elliptical-shaped outer projector shell. The Curie temperature Tm of the PMN-PT is selected to maximize the electrostrictive effects of the ceramic stack (102) for improving projector performance. The stack is surrounded by a heating coil which is controlled by a temperature/heater control mechanism to achieve and maintain the stack operating temperature within a fixed range. The ceramic stack is polarized by a d.c. biasing circuit signal and mechanical vibrations are generated within the stack by an a.c. driving circuit signal. The mechanical vibrations of the ceramic stack cause excursions in the outer projector shell which, in turn, produce acoustic signals in a body of water. First and second alternative embodiments are disclosed with each embodiment housing at least one PMN-PT ceramic stack.

20 Claims, 3 Drawing Sheets

LOW FREQUENCY SONAR PROJECTOR AND METHOD

TECHNICAL FIELD

The present invention generally relates to transducers. More specifically, the present invention relates to methods and apparatus for low frequency sonar projectors that convert electric signals to mechanically generated acoustic signals.

BACKGROUND ART

In the field of sonar, a transducer is employed in the detection of underwater objects and is either a transmitter or a receiver. A projector is a sonar transmitter utilized to convert electrical signals to mechanical vibrations while a receiver intercepts reflected signals. Projector transmitters and receivers are known and separate projector and receiver arrays are formed from multiple projectors and receivers, respectively. The arrays are then utilized in conjunction with a sea craft to detect the underwater objects.

A projector generally comprises an electromechanical stack element that converts electrical signals to mechanical vibrations. The stack element can be comprised of ceramic having a particular crystal structure. Ceramic projectors must be operated in an optimal temperature range to provide good performance. Further, ceramic projectors are normally operated in one of two operating regions depending upon the ceramic crystal structure. The two operating regions include the piezoelectric region and the electrostrictive region.

If the ceramic crystal is subjected to a high direct current voltage during the manufacturing process, the ceramic crystal becomes remanent polarized and operates in the piezoelectric region. The electrical signal is then applied to the ceramic stack to generate mechanical vibrations. As an alternative, direct current voltage can be temporarily applied to the ceramic stack during operation to provide polarization of the crystal. Under these conditions, the operation of the projector is in the electrostrictive region. After the application of the direct current voltage is discontinued, the ceramic stack is no longer polarized.

Many different types of sonar projectors are known. One particular type of projector is identified as a flextensional sonar projector which is a low frequency transducer. The low frequency transducer exhibits low attenuation of the acoustic signals in sea water. In general, a ceramic stack is housed within an elliptical-shaped outer projector shell. Vibration of the ceramic stack caused by application of an electrical signal produces magnified excursions in the outer projector shell. Thereafter, the excursions generate acoustic waves in the sea water. By way of example, one form of a flextensional transducer for underwater use can be found in PCT International Publication Number WO 87/05772.

A second type of sonar projector is known as the slotted cylinder projector. In the slotted cylinder projector, at least one ceramic stack or cylinder is enclosed within an outer cylindrical shell. A slice of the outer cylindrical shell and the ceramic cylinder are removed to form a slot. The vibrations of the ceramic cylinder are transferred to the edges of the outer cylindrical shell bordering the slot. The mechanical vibrations thereafter generate the acoustic waves in the sea water. A third type of sonar projector is the longitudinal vibrator projector which sandwiches the ceramic material between a head and a tail portion. The mechanical vibrations generated by the ceramic material are transmitted through the projector head.

Each of the above-described sonar projectors are known and, in general, utilize a ceramic material identified as PZT ceramic. PZT ceramic is a dense heavy material. Thus, an array of projectors each having a ceramic stack fashioned from PZT is extremely heavy (e.g., 30–40 tons). Therefore, a major problem associated with projector arrays of the prior art used to detect underwater objects is the weight of the array. Large amounts of energy must be expended to drag the projector arrays of the prior art utilizing PZT ceramic material through a body of water.

Other problems exist when using PZT ceramic material. In a slotted cylinder projector, the PZT ceramic material positioned within the outer cylindrical shell experiences high compressive stresses. The high compressive stresses cause the PZT ceramic material to become depolarized, e.g., to loose the remanent polarization. The polarization of the ceramic crystal is necessary to enable the applied electrical signal to generate the mechanical vibrations within the stack. Depolarization results in loss of the piezoelectric properties. Thus, the PZT ceramic material fails to function properly when exposed to the high compressive stresses.

Another known ceramic material suitable for fashioning a projector stack is lead magnesium niobate-lead titanate, hereinafter referred to as PMN-PT. Use of PMN-PT ceramic as the driver to generate mechanical vibrations in a sonar projector has been attempted. The PMN-PT ceramic material exhibits high electrostrictive activity. Therefore, use of the PMN-PT ceramic to fashion a sonar projector stack is attractive since a substantial increase in acoustic output signal is potentially available.

The characteristics of PMN-PT ceramic vary as a function as temperature. Therefore, it is essential that the thermal design of a projector utilizing PMN-PT material be stable. Stability must be achieved by maintaining the projector ceramic material close to a predetermined temperature. If the PMN-PT ceramic material is not operated within the predetermined temperature range, the dynamic acoustic electrostrictive characteristics of the ceramic material will decrease. A decrease in the electrostrictive characteristics of the ceramic material results in reduced performance of the sonar projector.

The affected dynamic acoustic electrostrictive characteristics of the PMN-PT material include strain, coupling and dielectric. In the art, the term strain is defined as the change in length of the ceramic stack over the original length that occurs as a result of applying an electric field to the stack. The term coupling is defined as the ability of the projector to transform electrical energy to mechanical energy. Finally, the term dielectric is defined as the potential power (either piezoelectric or electrostrictive) of the ceramic material.

Prior attempts to build a sonar projector having a ceramic stack comprised of PMN-PT material are known. This effort has been concentrated on lowering the internal losses in the crystal structure and in reducing the duty cycle of the projector. The internal losses are voltage type losses which tend to generate heat in the ceramic structure. For example, in a projector array developing (50–100) KW, the voltage type losses are substantial. The duty cycle of the projector is the percent of time during the complete cycle that the projector is transmitting. That portion of the duty cycle in which the projector is not transmitting is a projector "cool down" time. This procedure permits the temperature of the PMN-PT material to be stabilized close to the ambient temperature. Unfortunately, the procedure has proved to be somewhat impractical due to the inherent heat generation of very high powered sonar projectors and to inefficiency. The duty cycle was kept low to avoid heating effects.

The power output level of a sonar projector is high only within a certain temperature range. The ceramic material of the PMN-PT projectors of the prior art were formulated to operate at room temperature. This formulation provided lower internal losses and minimized temperature increases in the ceramic material. Unfortunately, the power generated caused the temperature of the projector to increase. The increased projector temperature exceeded the predetermined temperature range which resulted in a reduced the output signal.

Thus, a need remains in the art for an improvement in conventional sonar projectors for increasing the power level and duty cycle while simultaneously decreasing the size and weight.

DISCLOSURE OF INVENTION

The need in the art is addressed by the low frequency sonar projector and method of the present invention. The invention includes at least one ceramic stack comprised of lead magnesium niobate-lead titanate (PMN-PT) having a Curie temperature Tm approximately equal to the operating temperature of the projector. A mechanism is provided for applying heat to and for controlling the temperature of the ceramic stack to within a fixed operating range. A biasing circuit field is included for providing a first electrical signal to polarize the ceramic stack. A driving circuit field is also included for providing a second electrical signal to generate an output signal from the ceramic stack. Finally, a mechanism is included for transmitting the output signal from the ceramic stack to a fluid medium.

In a preferred embodiment, a PMN-PT ceramic stack is in intimate enclosed contact with an elliptical-shaped outer projector shell. The Curie temperature of the ceramic stack is selected to maximize the electrostrictive effects of the PMN-PT for improving projector performance. The stack is surrounded by a heating coil which is controlled by a temperature/heater control mechanism to achieve and maintain the stack operating temperature within a fixed range. The ceramic stack is polarized by a d.c. biasing circuit signal and mechanical vibrations are generated within the stack by an a.c. driving circuit signal. The mechanical vibrations of the ceramic stack cause excursions in the outer projector shell which, in turn, produce acoustic signals in a body of water. First and second alternative embodiments are disclosed with each embodiment housing at least one PMN-PT ceramic stack.

BEST MODES FOR CARRYING OUT THE INVENTION

Figure 1:
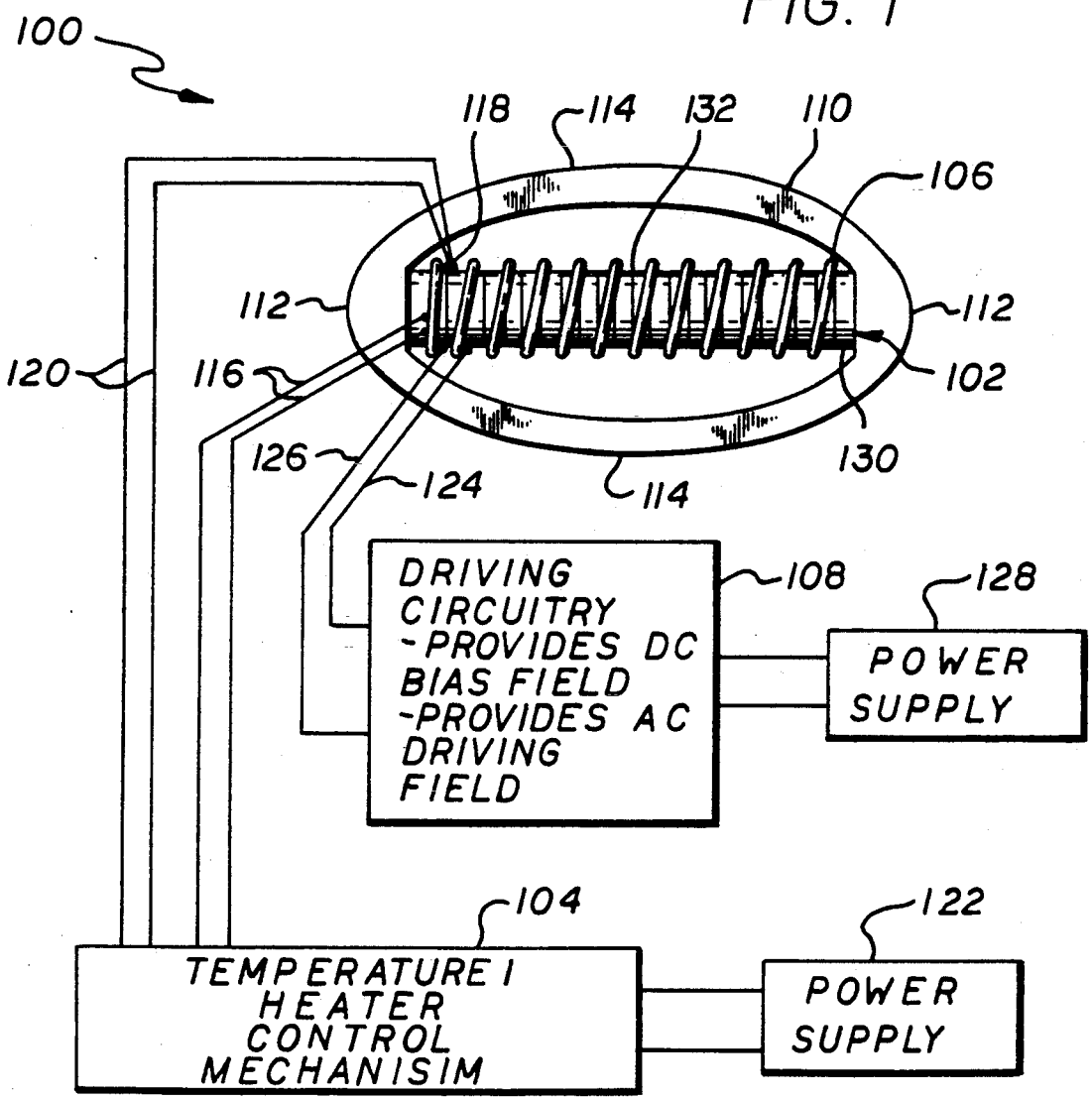
FIG. 1 is a simplified cross-sectional view of an illustrative embodiment of the low frequency sonar projector of the present invention showing a PMN-PT ceramic stack electrically connected to driving and temperature control circuitry in block form.

The invention is embodied in a low frequency sonar projector 100 of the type having a ceramic stack 102 comprised of lead magnesium niobate-lead titanate (hereinafter PMN-PT) material for providing a substantially higher power output signal level and a temperature/heater control mechanism 104 for applying heat to and controlling the temperature of the PMN-PT ceramic stack 102 as shown in FIG. 1. Generally, the temperature/heater control mechanism 104 and a heating coil 106 cooperate to initially establish and maintain the temperature of the PMN-PT ceramic stack 102 while a driving circuit 108 polarizes the stack 102 with a d.c. bias field and then excites the stack 102 with an a.c. driving circuit field to generate mechanical vibrations. Further, the projector 100 increases the output signal power level by (6–10) dB, reduces the weight and size of a projector array by 75% and improves the efficiency by extending the duty cycle.

The low frequency sonar projector 100 of the present invention is illustrated in FIG. 1 as a flextensional projector utilizing PMN-PT material for the ceramic stack 102. The ceramic stack 102 is housed within an elliptical-shaped outer projector shell 110 comprised of, for example, aluminum or fiberglass. In general, ceramic is very brittle and cannot withstand tensile stress without being damaged. However, in order to transmit acoustic signals in seawater, strain is applied to the stack 102. Specifically, when the PMN-PT ceramic stack 102 is polarized by applying a d.c. voltage, the stack grows in the longitudinal direction and applies strain to the ends 112 of the elliptical-shaped outer shell 110. The strain so applied causes small excursions at the ends 112 but large excursions along the length 114 of the elliptical-shaped outer shell 110 as shown by the arrows in FIG. 2. Thus, the PMN-PT ceramic stack 102 functions as a driver to generate mechanical vibrations in the outer shell 110. The large excursions or mechanical vibrations along the length 114 of the outer shell 110 create acoustic waves in the seawater.

The strain applied to the stack 102 during application of voltage must be offset in order to avoid damage to the ceramic stack. This is accomplished by mechanically precompressing the ceramic stack 102 with the outer projector shell 110 prior to applying the voltage to the stack. The ceramic stack 102 is physically fitted against the inside surface of the ends 112 of the outer shell 110 so that a sufficient prestress level exists. Thus, the PMN-PT ceramic can grow in the longitudinal direction when a large voltage is applied without damaging the ceramic stack 102 since the growth offsets the prestress. The prestress level also ensures sufficient mechanical contact between the ceramic stack 102 and the outer shell 110.

Another reason for prestressing the ceramic stack 102 is that at operating depth, the seawater applies pressure to the length 114 of the elliptical-shaped outer shell 110. This phenomena is indicated by the arrows in FIG. 2. The precompression will be diminished as the sonar projector 100 is lowered further into the water. Thus, the initial prestress level must be adequate in order to properly utilize the projector 100 at the desired operating level.

Wrapped about the PMN-PT ceramic stack 102 within the outer projector shell 110 is the heating coil 106. The heating coil 106 is electrically connected to the temperature/heater control mechanism 104 via a pair of heating coil leads 116 as shown in FIG. 1. A plurality of temperature sensors 118 are distributed along the outer surface of the PMN-PT ceramic stack 102. Although only a single temperature sensor 118 is symbolized in FIG. 1, the number of temperature sensors 118 and their distribution is dependent upon the design of the ceramic stack and the thermal criteria. The symbolized temperature sensor 118 is connected to the temperature/heater control mechanism 104 by sensors leads 120.

The temperature/heater control mechanism 104 in combination with the heating coil 106 and the temperature sensors 118 serve to initially raise the PMN-PT material to the operating temperature and thereafter to stabilize the temperature during projector off-periods. The temperature/heater control mechanism 104 can be any one of a plurality of thermostatically controlled heating devices known in the art. A thermostat (not shown) located within the control mechanism 104 serves to regulate an electrical current flow to the heating coil 106. A power supply 122 is shown in FIG. 1 as a source of electrical power to energize the control mechanism 104. The power supply 122 can be a standard 110 volt, 60 Hz, single phase power source.

The heating coil 106 can be comprised of any suitable metal or alloy having a high heat transfer coefficient. The heating coil 106 receives the electrical current transmitted from the control mechanism 104 via the heating coil leads 116. The electrical current causes the heating coil 106 to transmit heat to the PMN-PT ceramic stack 102. The temperature of the ceramic stack 102 is monitored by the temperature sensors 118 which transmit a feedback signal to the control mechanism 104. The setting of the control thermostat (not shown) in the control mechanism 104 regulates the temperature of the ceramic stack 102.

It is known that the ceramic material utilized in the stack 102 can possess either piezoelectric or electrostrictive properties. Thus, the function of the driving circuit 108 is twofold. Initially, the driving circuit 108 serves to apply a d.c. bias field to the PMN-PT ceramic stack 102 via conductor leads 124. The d.c. bias field is a voltage of, for example 2500 VDC, utilized to polarize the ceramic stack 102. The polarization of the ceramic crystal permits the stack 102 to possess the electrostrictive properties of strain, coupling and dielectric that are favorable to providing a stronger projector output signal. The d.c. bias field also serves to set an operating point on the relevant stain-electric field curve for an a.c. driving circuit field to operate about. The strain-electric field curve will be discussed with reference to FIG. 3 hereinbelow. Application of the d.c. bias field to the PMN-PT ceramic stack 102 keeps the ceramic crystal polarized notwithstanding the compressive stresses that cause PZT ceramic to loose remanent polarization.

After the stack 102 has been polarized by the applied d.c. bias field, the a.c. driving circuit field is applied to the stack 102 via conductor leads 126. The a.c. driving field is an a.c. voltage that is provided by the driving circuit 108 and can be any suitable periodic function, for example, a 1600 VAC sinusoid. The a.c. driving circuit field is selected to ensure that the outer projector shell 110 generates a specific signal to impart to the seawater which is utilized to locate underwater objects. A driving circuit power supply 128 delivers electrical power to the driving circuit 108 as shown in FIG. 1. The power supply 128 can be obtained from a.c. and d.c. sources of ships power or from another suitable source, if desired.

The driving circuit 108 is shown as the source of both the d.c. bias field and the a.c. driving circuit field. As a practical matter, the d.c. bias field portion of the driving circuit 108 can be provided directly from the power supply 128 or the driving circuit 108 can include a rectifying bridge and filter (not shown) that converts an a.c. to a d.c. voltage. Likewise, the a.c. driving circuit field portion of the driving circuit 108 can be provided directly from power supply 128 with a wave shaping circuit (not shown) included therein.

Figure 2:
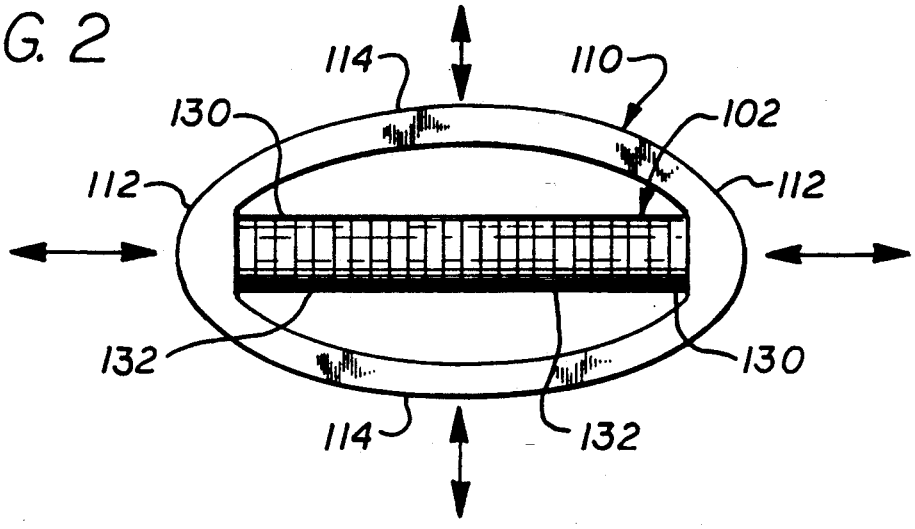
FIG. 2 is a simplified cross-sectional view of the PMN-PT ceramic stack of FIG. 1 shown positioned within an outer projector shell.

The ceramic stack 102 can be comprised of a plurality of individual stacks fitted along the major axis of the elliptical-shaped outer projector shell 110 as shown in FIGS. 1 and 2. The stacks consist of a number of piezoelectric plates 130 between which are sandwiched metal electrodes 132. The metal electrodes 132 are connected together, for example, in parallel. The entire ceramic stack 102 is then prestress fitted within the elliptical-shaped outer projector shell 110 as shown in FIG. 2.

The piezoelectric properties of PMN-PT ceramic are maximized around the Curie temperature Tm. The Curie temperature Tm is defined as the temperature at which the PMN-PT material characteristics change from the piezoelectric to the electrostrictive regions. The Curie temperature Tm can be varied by the percentage of lead titanate (PT) in the composition of PMN-PT material. The PMN-PT composition is formulated so that the Curie temperature Tm is within the range of approximately (10–15) degrees Centigrade of the operating temperature of the sonar projector 100 due to its internal heating losses. Further, the heating coil 106 is used as a glow plug to initially raise the PMN-PT material to the operating temperature and thereafter to stabilize the temperature during projector off-periods.

In general, lead magnesium niobate (PMN) material losses its polarization Po above a temperature $T_c$. The temperature $T_c$ is below the Curie temperature $T_m$ of the PMN material. Under these conditions, the PMN material possesses electrostrictive properties and exhibits excellent characteristics for use as a driver material in the underwater sonar projectors 100. In particular, the electrostrictive properties of strain, coupling and dielectric are maximized to improve the performance of the projector 100. Unfortunately, as the temperature of the PMN material rises above the Curie temperature Tm, these desirable electrostrictive characteristics degrade substantially. Therefore, PMN material must be operated within a limited temperature range in order to maintain these desirable electrostrictive characteristics.

In order for the PMN-PT ceramic stack 102 to operate within a limited temperature range to achieve temperature control, several transducer characteristics must be balanced. Initially, the thermal design of the projector 100 must be balanced against the temperature characteristics of the specific PMN material utilized. Additionally, the prestress levels of the PMN material necessary to avoid damage to the ceramic stack 102 must also be balanced against the specific characteristics of the PMN material utilized. As the prestress level in the PMN driver material is altered, the characteristics of the PMN material will shift. Therefore, in view of the anticipated levels of prestress and temperature, the specific composition of the PMN material must be selected to optimize performance of the projector 100.

INDUSTRIAL APPLICABILITY

The projector 100 is employed to detect underwater objects in the following manner. As the projector 100 is lowered deeper into the seawater, hydrostatic pressure forces the outer projector shell 110 to collapse and release the initial prestress as is indicated by the arrows in FIG. 2. At the operational depth, the remaining prestress on the PMN is due to the interference fit with the outer projector shell 110. The remaining prestress must be such that the dynamic stresses associated with the a.c. driving circuit field do not place the PMN material into tension.

Once the projector 100 is located at the operating depth, the heating coil 106 is energized from the temperature/heater control mechanism 104. The heating coil 106 warms the PMN-PT driver material of the ceramic stack 102 to slightly below the optimum temperature, e.g., the Curie temperature Tm. At this temperature, the PMN-PT material exhibits a high strain characteristic and high internal losses. The high strain characteristic causes changes in the molecular structure and movement in the crystal and is associated with the d.c. bias voltage applied to polarize the ceramic stack 102. The high internal losses of the PMN-PT ceramic material refer to the voltage type heating losses caused by the changes in the crystal molecular structure.

Figure 3:
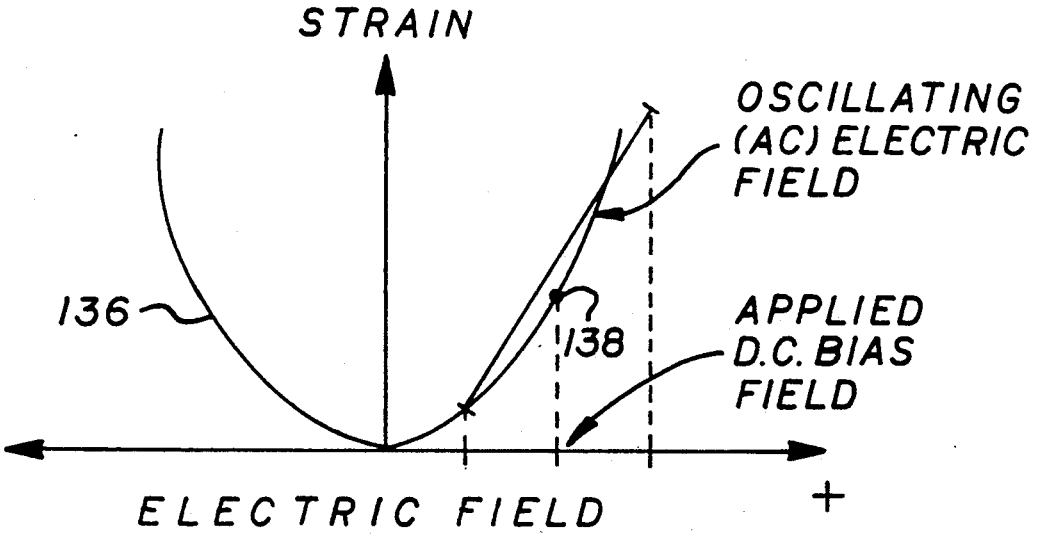
FIG. 3 is a graph of strain versus electric field applied to the ceramic stack of FIG. 1 showing the a.c. signal oscillating about a d.c. offset point.

The d.c. bias field is then applied by the driving circuit 108 to bias the PMN material to one side or the other of the strain versus electric field curve 136 shown in FIG. 3. The strain characteristic is the change in length of the ceramic stack 102 over the original length that occurs as a result of applying an electric field to the stack 102. The graph of FIG. 3 shows strain plotted on the vertical axis and electric field plotted on the horizontal axis. The application of the d.c. voltage biases the PMN material to the positive side of curve 136 and sets an operating point 138 for the a.c. driving circuit field. The position of the operating point 138 on the curve 136 corresponds to the magnitude of the applied d.c. voltage. Thereafter, the a.c. driving circuit field is initiated. The a.c. driving circuit field is an electric voltage which oscillates about the operating point 138 on the curve 136.

Establishing the operating point 138 on the curve 136 of FIG. 3 is necessary to avoid the problem of frequency doubling. The a.c driving circuit field oscillates in both the positive and negative directions. If the applied d.c. bias voltage is zero volts, the operating point of the applied a.c. driving circuit field is at the origin of the curve 136. The frequency of the a.c. signal would double since the negative portion of the d.c. signal would be clipped. By superimposing the oscillating a.c. driving circuit field over the d.c. bias field, the problem of frequency doubling is avoided. This is the case since a one-to-one relationship exists between strain and the electric field. Different magnitudes of d.c. biasing circuit voltage and a.c. driving circuit voltage can be combined to provide different projector characteristics. In this manner, an optimal combination can be established. It is noted that the different magnitudes of the d.c. and a.c. voltages are selected so as not to exceed a predetermined internal transducer voltage.

After the a.c driving circuit field is initiated, the ceramic stack 102 begins to vibrate. During vibration, energy is lost in the PMN-PT dielectric material. The internal heating losses of the ceramic stack 102 which results from poor heat dissipation causes the temperature of the stack to increase. As the temperature of the PMN-PT material increases, the internal dielectric loss characteristics are reduced and less heat is generated. Thus, given a continuous wave pulse, the PMN-PT material is thermally self-limiting. At some specified temperature, the internal heat loss of the PMN-PT material will exactly balance the heat dissipated from the projector 100.

In theory, this is an ideal transducer. However, this transducer can only be approximated in a real projector. In a real projector, the PMN-PT driver material actually exhibits a temperature distribution. Thus, the temperature of the PMN-PT is not uniform. Therefore, various sections of the PMN-PT ceramic stack 102 will be thermally self-limiting at different times and temperature will redistribute within the ceramic stack 102 over time. The temperature redistribution process will continue indefinitely for a continuous wave drive condition. A continuous wave drive condition can have a low duty cycle e.g., 10%-20%) in which the projector 100 is operative, for example, two-to-three minutes and is non-operative for twenty-to-thirty minutes. The non-operative or "off period" of the projector 100 serves as a cool down period for the ceramic stack 102. When the projector 100 is in a pulsed drive condition, the process described with respect to the continuous wave drive condition is also initiated. Thus, the d.c. bias field is initially applied to the stack 102 and the a.c. driving circuit field is applied thereafter. However, the application of the d.c. and a.c. fields will be interrupted when the pulse ends. As the pulse ends, the PMN-PT driver material will begin to cool by natural heat conduction and convection away from the projector 100.

The cooling of the PMN-PT material is undesirable since the driver characteristics degrade as temperature decreases. Therefore, the heating coil 106 will be energized by the temperature/heater control mechanism 104 to maintain the PMN-PT material at some predetermined minimum temperature until the pulse begins again. A continuous process of self-heating and thermal self-limiting of the ceramic stack 102, and the energizing and deenergizing of the heating coil 106 maintains the PMN-PT material within some desired temperature range. Under these conditions, optimal transducer performance is provided by the projector 100 of the present invention.

For the implemented projector 100 shown in FIG. 1, an example operating temperature is ninety degrees Centigrade. However, it is important to be familiar with the thermal characteristics and the operative duty cycle of the individual projector and the temperature of the water in which the projector will be utilized. After this data has been considered, the PMN-PT material is formulated to have a Curie temperature Tm within a range of (10–15) degrees Centigrade of the operating temperature of the projector 100. When the Curie temperature Tm of the PMN-PT material is approximately equal to the operating temperature of the projector 100, the electrostrictive characteristics and thus the projector output signal are maximized.

The low frequency sonar projector of the present invention is not limited to the flextensional variety. Thus, a first alternative embodiment of the low frequency sonar projector identified by the reference numeral 200 is disclosed in FIGS. 4 and 5. The sonar projector 200 is a slotted cylinder projector which includes an outer cylindrical shell 202. The outer shell 202 can be comprised of steel, aluminum, plastic or any suitable solid material. The outer shell 202 is shown having a plurality of PMN-PT ceramic stacks or cylinders 204 attached to an inside surface 206 of the outer shell. Each PMN-PT ceramic cylinder 204 is intimately bonded to the inside surface 206 of the outer shell 202 as with an adhesive. Therefore, the PMN-PT ceramic cylinders 204 move in unison with the outer shell 202.

Figure 4:
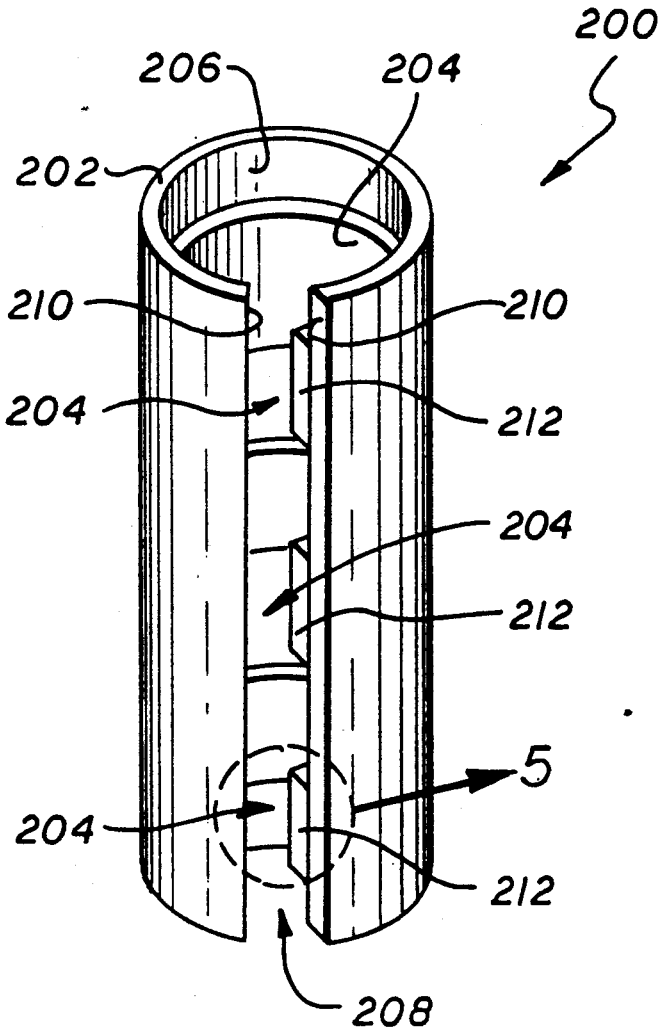
FIG. 4 is a simplified perspective view of a first alternative embodiment of the low frequency sonar projector of the present invention showing the use of multiple PMN-PT ceramic stacks in a slotted cylinder projector.
Figure 5:
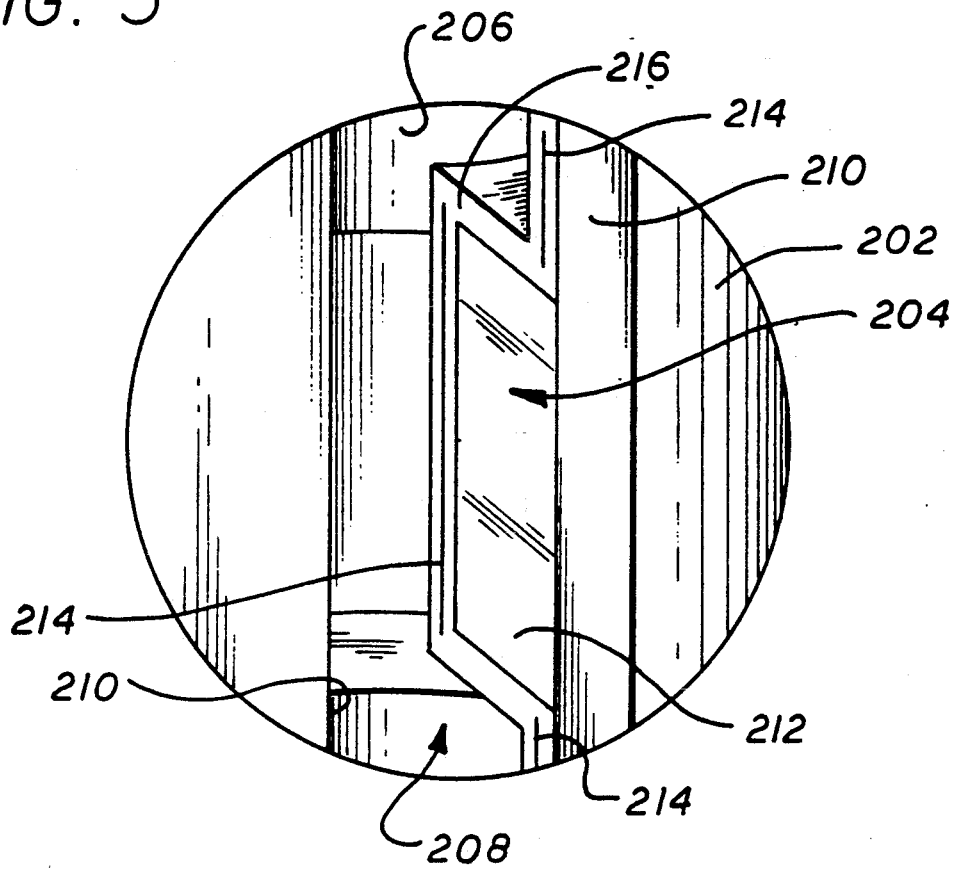
FIG. 5 is an enlarged partial perspective view of one of the PMN-PT ceramic stacks of FIG. 4 shown mounted in the slotted cylinder projector.

A slice of the outer cylindrical shell 202 and each of the PMN-PT ceramic cylinders 204 is removed to form a slot 208 best shown in FIG. 4. Thus, the slot 208 in the outer shell 202 is identical to and concentric with the slot in each of the PMN-PT ceramic cylinders 204. An inner diameter and an outer diameter of the outer shell 202 are clearly visible in FIG. 4 and form two opposing surfaces or lips 210. Further, an exposed rectangular-shaped inside surface 212 of each of the PMN-PT ceramic cylinders 204 is also shown in FIGS. 4 and 5.

Each of the PMN-PT ceramic cylinders 204 is mounted in a prestressed relationship with the outer shell 202. The prestress level in the projector 200 exists for the identical reasons as the prestress level of the projector 100. The level of prestress existing between the outer shell 202 and the PMN-PT ceramic cylinders 204 is sufficient to counteract the strain experienced during operation of the projector 200.

Further, a heating mechanism is provided in the projector 200 which cooperates with a temperature/heater control mechanism and power supply (not shown) to initially establish and maintain the temperature of the PMN-PT ceramic cylinders 204. The heating mechanism is shown in FIG. 5 as an encapsulated thermofoil 214. However, a heating coil designed for this particular application would also be suitable. The temperature/-heater control mechanism (not shown) serves the identical function as that in the projector 100, e.g., to energize the thermofoil 214. A plurality of temperature sensors (not shown) can also be utilized to feedback temperature data to the control mechanism for controlling the temperature of the PMN-PT ceramic cylinders 204. An optional heat conductive elastomer 216 can be placed over the outer perimeter of the exposed inside surface 212 of the PMN-PT ceramic cylinders. The optional elastomer 216 improves the heat transfer to the ceramic and assists in maintaining the operating temperature of the projector 200.

In operation, a d.c. biasing circuit field is initially applied by a driving circuit and power supply (not shown) to polarize and bias the PMN-PT ceramic cylinders 204 in accordance with the previously described strain versus electric field curve 136 of FIG. 3. An operating point 138 is established for the subsequently applied a.c. driving circuit field which generates mechanical vibrations in the ceramic cylinders 204. The mechanical vibrations are transferred to the interconnected outer shell 202. The small vibration excursions in the outer shell 202 are registered as large excursions in the opposing surfaces or lips 210 bordering the slot 208. The excursions in the lips 210 are transformed into acoustic energy and transmitted to the seawater.

Figure 6:
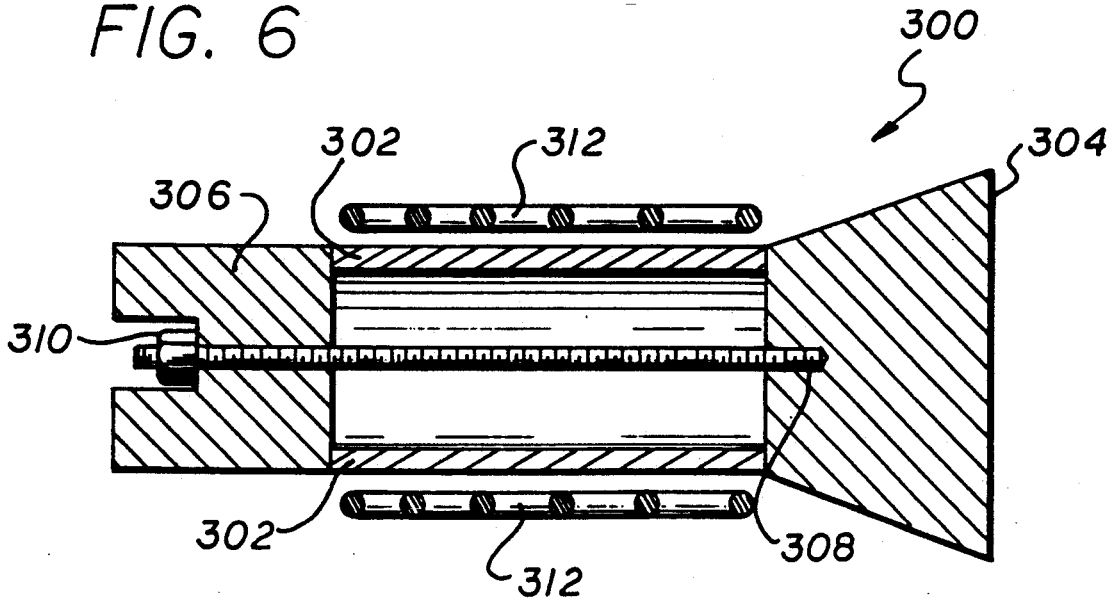
FIG. 6 is a simplified cross-sectional view of a second alternative embodiment of the low frequency sonar projector of the present invention showing a PMN-PT ceramic stack mounted within a longitudinal vibrator projector.

A second alternative embodiment of the low frequency sonar projector identified by the reference numeral 300 is disclosed in FIG. 6. FIG. 6 shows a cross-sectional view of a circular longitudinal vibrator projector 300. The projector 300 includes a PMN-PT cylindrical ceramic stack 302 sandwiched between a head portion 304 and a tail portion 306. The head and tail portions 304 and 306, respectively, are solid pieces comprised of an appropriate material such as steel, aluminum or hard plastic. The head portion 304 is larger than the tail portion 306 and serves to transmit mechanical vibrations to the seawater.

A threaded bolt 308 and corresponding nut 310 function as a clamp to hold the entire longitudinal vibrator projector 300 together and to provide the required level of prestress compression to the PMN-PT cylindrical stack 302. The threaded bolt 308 permits the prestress level to be adjusted for the materials utilized. As in the previous projector embodiments, the prestress level prevents the ceramic from experiencing high tensile stress due to high dynamic strain. The ceramic will tolerate the compressive stress without damage but not the strain. Thus, threaded bolt 308 and the nut 310 ensure that the ceramic will not be damaged from the stain.

A heating coil 312 is shown as the mechanism for applying heat to the PMN-PT cylindrical stack 302. The heating coil 312 acts in concert with a temperature/heater control mechanism and power supply (not shown) to initially establish and maintain the temperature of the PMN-PT cylindrical stack 302. Temperature sensors (not shown) can also be employed to feedback temperature data to the temperature/heater control mechanism as previously discussed.

In operation, a d.c. biasing circuit field is initially applied by a driving circuit and power supply (not shown) to polarize and bias the PMN-PT cylindrical stack 302 in accordance with the previously described strain versus electric field curve 136 of FIG. 3. The operating point 138 is established for the subsequently applied a.c. driving circuit field which generates mechanical vibrations in the larger and heavier head 304. The mechanical vibrations are transferred to the seawater to create acoustic signals. A low frequency sonar projector 100 for use in a projector array and a method therefore has been disclosed. In the present invention, at least one ceramic stack 102 comprised of PMN-PT having a Curie temperature Tm approximately equal to the operating temperature of the projector 100 is disclosed. A heating coil 106 and control mechanism 104 are provided for applying heat to and for controlling the temperature of the ceramic stack 102 to within a fixed operating range. A driving circuit 108 is included for providing a d.c. biasing circuit field to polarize the ceramic stack and to apply an a.c. driving circuit field for generating a mechanical output signal from the ceramic stack 102. Finally, the outer projector shell 110 is included for transmitting the mechanical output signal from the ceramic stack 102 to a fluid medium. The Curie temperature Tm of the PMN-PT is selected to maximize the electrostrictive effects of the ceramic stack 102 for improving projector performance. Further, the projector 100 increases the output signal power level by (6–10) dB, reduces the weight and size of a projector array by 75% and improves the efficiency by extending the duty cycle.

Thus, the present invention has been described herein with reference to a particular embodiment for a particular application. Those having ordinary skill in the art and access to the present teachings will recognize additional modifications, applications and embodiments within the scope thereof. It is therefore intended by the appended claims to cover any and all such modifications, applications and embodiments within the scope of the present invention.

Accordingly,

What is claimed is:

1. A low frequency sonar projector for use in a projector array comprising:

at least one ceramic stack comprised of lead magnesium niobate-lead titanate having a Curie temperature Tm approximately equal to the operating temperature of said projector;

means for applying heat to and controlling the temperature of said ceramic stack to within a fixed operating range;

biasing means for providing a first electrical signal to polarize said ceramic stack;

driving means for providing a second electrical signal to generate an output signal from said ceramic stack; and means for transmitting said output signal from said ceramic stack to a fluid medium.

2. The low frequency sonar projector of claim 1 wherein said means for applying heat to said ceramic stack includes a heating coil.

3. The low frequency sonar projector of claim 1 wherein said means for applying heat to said ceramic stack includes an encapsulated thermofoil.

4. The low frequency sonar projector of claim 1 wherein said means for applying heat to said ceramic stack includes a heat conductive elastomer.

5. The low frequency sonar projector of claim 1 wherein said means for controlling the temperature of said ceramic stack includes a temperature control mechanism.

6. The low frequency sonar projector of claim 1 wherein said means for controlling the temperature of said ceramic stack includes a plurality of temperature sensors.

7. The low frequency sonar projector of claim 1 wherein said biasing means comprises a direct current circuit and said first electrical signal is a direct current signal.

8. The low frequency sonar projector of claim 1 wherein said driving means comprises an alternating current circuit and said second electrical signal is an alternating current signal.

9. The low frequency sonar projector of claim 1 wherein said transmitting means comprises an outer projector shell.

10. The low frequency sonar projector of claim 1 wherein said transmitting means comprises a slotted cylinder.

11. The low frequency sonar projector of claim 1 wherein said transmitting means comprises a longitudinal vibrator head.

12. The low frequency sonar projector of claim 1 further including means for prestressing said ceramic stack to eliminate tensile stress during operation of said projector.

13. The low frequency sonar projector of claim 12 wherein said prestressing means includes an outer projector shell.

14. The low frequency sonar projector of claim 12 wherein said prestressing means includes a slotted cylinder.

15. The low frequency sonar projector of claim 12 wherein said prestressing means includes a means for clamping said ceramic stack between a head and a tail of said projector.

16. A low frequency sonar projector for use in a projector array comprising:

at least one ceramic stack comprised of lead magnesium niobate-lead titanate having a Curie temperature Tm approximately equal to the operating temperature of said projector;

means for applying heat to and controlling the temperature of said ceramic stack to within a fixed operating range;

a direct current biasing circuit in contact with said ceramic stack for providing a direct current signal to polarize said ceramic stack;

an alternating current driving circuit in contact with said ceramic stack for providing an alternating current signal to generate an output signal from said ceramic stack; and means for transmitting said output signal from said ceramic stack to a fluid medium.

17. A method of constructing a low frequency sonar projector for use in a projector array, said method comprising the steps of:

providing at least one ceramic stack comprised of lead magnesium niobate-lead titanate having a Curie temperature Tm approximately equal to the operating temperature of said projector;

applying heat to and controlling the temperature of said ceramic stack to within a fixed operating range;

biasing said ceramic stack with a direct current signal for polarizing said ceramic stack;

driving said ceramic stack with an alternating current signal for generating an output signal from said ceramic stack; and transmitting said output signal from said ceramic stack to a fluid medium.

18. The method of claim 17 further including the step of sensing the temperature of the ceramic stack with a plurality of temperature sensors.

19. The method of claim 17 further including the step of prestressing said ceramic stack to eliminate tensile stress during operation of said projector.

20. The method of claim 17 wherein said step of heating said ceramic stack includes the step of preheating said ceramic stack to the operating temperature and the step of maintaining the operating temperature during off periods of the duty cycle.

* * * * *